US005657662A

United States Patent [19]

Kariofyllis

[11] Patent Number: 5,657,662

[45] Date of Patent: Aug. 19, 1997

[54] BENDING BRAKE PLATFORM

[76] Inventor: Daniel Kariofyllis, 33 Selma Ave., Derby, Conn. 06418

[21] Appl. No.: 507,010

[22] Filed: Jul. 25, 1995

[51] Int. Cl.[6] ..... B21D 11/00

[52] U.S. Cl. ..... 72/320; 72/419

[58] Field of Search ..... 72/319, 320, 321, 72/322, 323, 419; 248/637, 643, 671, 674

[56] References Cited

U.S. PATENT DOCUMENTS

| | | | |
|---|---|---|---|
| 3,161,223 | 12/1964 | Marsh | 153/16 |
| 3,481,174 | 12/1969 | Barnack | 72/319 |
| 3,482,427 | 12/1969 | Barnack | 732/319 |
| 3,559,444 | 2/1971 | Blazey et al. | 72/319 |
| 3,815,393 | 6/1974 | Daniels | 72/320 |
| 3,817,075 | 6/1974 | Marsh et al. | 72/319 |
| 4,240,279 | 12/1980 | Rhoades | 72/319 |
| 4,305,508 | 12/1981 | Rodgers | 248/671 |
| 4,321,817 | 3/1982 | Barnack | 72/319 |
| 4,364,254 | 12/1982 | Chubb et al. | 72/319 |
| 4,455,857 | 6/1984 | Salvagnini | 72/320 |
| 4,512,174 | 4/1985 | Rhoades | 72/319 |
| 4,804,162 | 2/1989 | Rice | 248/671 |
| 4,918,966 | 4/1990 | Raccioppi, Jr. | 72/419 |

OTHER PUBLICATIONS

ABC Supply Company Inc., "Tools for Building Success" 1995 Catalog, pp. 52 and 53.

*Primary Examiner*—David Jones
*Assistant Examiner*—John Paradiso
*Attorney, Agent, or Firm*—DeLio & Peterson, LLC

[57] ABSTRACT

Conventional sheet bending brakes are modified to provide a platform which is easy to assemble or disassemble and which is positioned at the top of the brake for ease of working the sheet material comprising platform brackets which are secured to the upper arm of the C-shaped bracket of the brake forming a substantially level support surface essentially transverse to the longitudinal axis of the brake and the platform positioned thereon.

4 Claims, 3 Drawing Sheets

BENDING BRAKE PLATFORM

BACKGROUND OF THE INVENTION

1. Field of the Invention

The present invention relates to sheet bending brakes for bending sheet material such as aluminum and vinyl used for siding buildings and other construction uses and, in particular, to a portable platform which may be easily installed and/or removed from the sheet bending brake.

2. Description of Related Art

Sheet bending brakes are well known in the art of building construction for bending sheet material such as aluminum and vinyl on the job site which bent sheet material is then applied as siding or window trim to a building. In general, a sheet bending brake clamps the sheet material between an anvil member and a clamping surface and a hinged bending member bends the sheet material about the anvil member. Typical sheet bending brakes are disclosed in U.S. Pat. Nos. 3,161,223; 3,481,174; 3,482,427; 3,559,444; 3,817,075; 4,240,279; 4,321,817; 4,364,254; and 4,512,174. Sheet bending brakes are also shown in ABC Supply Company Inc. Catalog, 1995, on page 52 as Tapco's "Pro III Port-O-Bender", "Windy Port-O-Brake" and "Max-i-mum Brakes". The above patents and catalog are hereby incorporated by reference. Broadly stated, a bending brake comprises a frame, a jaw formed of C-shaped members to accommodate the sheet material, clamping, anvil and bending members.

The sheet material to be bent is normally supplied as a coil and must be uncoiled, measured, cut and bent before it can be applied to the building or other construction site. These operations are difficult to perform because of the nature of the coil and coilers have been developed to provide a simple and effective way to hold the coil and to unroll the amount of material needed when desired. Typical coilers are shown in the ABC catalog, supra, on page 53, as the Tapco Port-O-Coiler and Tapco Pro II Coiler. Brake users typically perform the uncoiling, measuring and cutting of the material on the ground or on a separate table which procedures are inefficient and time consuming and are not cost effective. Also, it is often necessary to place a cut sheet of material aside while working on another piece and storage and retrieval of such cut material is another problem facing the user.

These problems have been recognized in the industry and a number of patents have issued showing a combined sheet bending brake and platform which will support a piece of sheet material without interfering with the operation of the brake. In U.S. Pat. No. 4,364,254, supra, a table is permanently secured to the sheet bending brake and extends horizontally and rearwardly from the clamping surface (front) of the sheet bending brake and a coil stand is mounted on the end of the sheet bending brake. The axis of the roll of sheet stock extends transversely to the longitudinal axis of the sheet bending brake so that a length of sheet material can be unrolled from the coil stand onto the table, severed from the remainder of the coiled stock and manually transferred from the table to the sheet bending brake for bending. The table is mounted on a plurality of longitudinally spaced brackets which are pivotally attached to the C-shaped members of the brake in the area of the juncture of the upper and lower arms of the C-shaped members and preferably adjacent the lower arm by an arrangement which includes bolts extending through the C-shaped members. When not in use the table is designed to be pivoted rearwardly out of the area of the sheet bending brake. When the table is in the horizontal position for use hand knobs and bolts are used to secure and limit the upperward movement of the table with the bolt extending beneath a flange of the upper arm of the C-shaped member. This patent also discloses that the coil stand is secured to the brake frame by brackets on the coil which extend into tubular rails of the brake frame.

In U.S. Pat. No. 4,512,174, supra, a platform for a bending brake is shown wherein the platform is connected to the frame of the bending brake to provide a platform which is below the upper arm of the C-shaped members and at about the level of the lower arm of the C-shaped member and at the rear of the bending brake. This design is only useful for storing sheet material and is of no use to facilitate measuring, cutting and bending of the sheet material.

As far as applicant is aware, there is no bending brake having a combined platform or table which platform is easy to install and/or remove and is inexpensive and effective for the contractor to use. The table of the combined sheet bending brake, table and coil support of U.S. Pat. No. 4,364,254, supra, is difficult to assemble to its horizontal position, makes the bending brake heavy since it is an integral permanent part of the brake structure and the brake is unwieldly to store and move.

Bearing in mind the problems and deficiencies of the prior art, it is therefore an object of the present invention to provide a sheet bending brake having a platform which platform is easy to install and/or remove and which is inexpensive and effective for use by the user of the brake.

A further object of the invention is to provide a platform bracket for use with a bending brake to provide a support surface for supporting a platform.

Other objects and advantages will be apparent from the following description.

SUMMARY OF THE INVENTION

It has now been found that conventional sheet bending brakes may be modified to provide a platform on the brake which is within working reach of the person using the brake and which is easy to assemble and disassemble comprising a plurality of platform brackets which are easily secured to the upper arm of C-shaped members of the bending brake forming a substantially horizontal support surface on which a platform extending longitudinally for at least a portion of the length of the brake can be positioned on. The platform and platform brackets may be easily removed from the brake after use of the brake. The platform brackets comprise a support member fixedly attached to a holding member, the holding member being attached to the C-shaped member by, for example, a force or friction fit, to secure it to the C-shaped member.

Broadly stated, a combined sheet bending brake and platform comprises: a base or frame;

a plurality of C-shaped members secured on the base at longitudinally spaced points substantially transverse to the longitudinal axis of the brake;

each C-shaped member comprising a lower arm fixed to the base and an upper arm spaced from and overlying said lower arm and a connecting portion connecting the lower arm and upper arm the C-shaped member forming a jaw opening therebetween the upper arm and lower arm;

an anvil member;

a clamping surface for holding the sheet;

a bending member hinged for bending the sheet material about the anvil member; and a plurality of platform brackets each bracket being secured to an upper arm of a C-shaped member forming a support surface preferably substantially transverse to the longitudinal axis of the brake on which a platform extending longitudinally for at least a portion of the length of the brake can be positioned on.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

Figure 1:
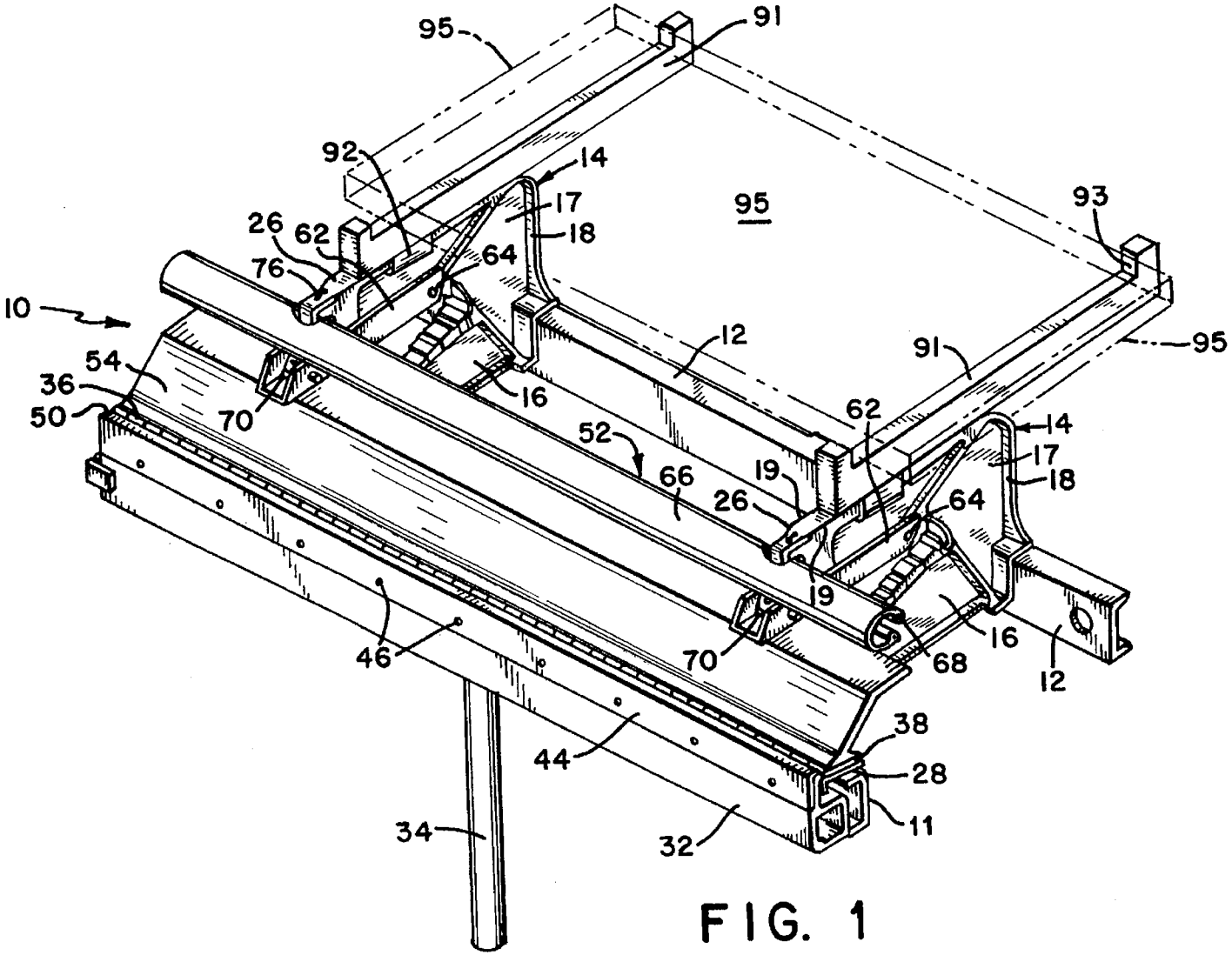
FIG. 1 is a perspective view of a conventional bending brake modified according to the invention.

In describing the preferred embodiment of the present invention, reference will be made herein to FIGS. 1–4 of the drawings in which like numerals refer to like features of the invention. Features of the invention are not necessarily shown to scale in the drawings.

Referring to FIG. 1, the brake is adapted to be placed upon a bench, horses or like supporting devices (not shown) so as to dispose the brake at a convenient height above the ground or floor for operating purposes. A bending brake shown as 10 is typical of the bending brakes used in industry. Any conventional bending brake may be used in the present invention if the brake has structural members upon which platform support members may be secured to as discussed hereinbelow.

The bending brake 10 has a base or frame formed from a pair of C-shaped rails, front rail 11 and rear rail 12 usually made of aluminum extrusion and disposed and spaced parallel to each other. Conceivably, a single rail or other frame of adequate dimensions could be used in lieu of the pair of such rails. The rails form the frame of the brake and in a preferred embodiment the supporting device has cut-outs in which the rails sit to provide a secure assembly. In a highly preferred embodiment, front rail 11 sits in a mating L shaped cut-out at the front end of the support device.

Figure 2:
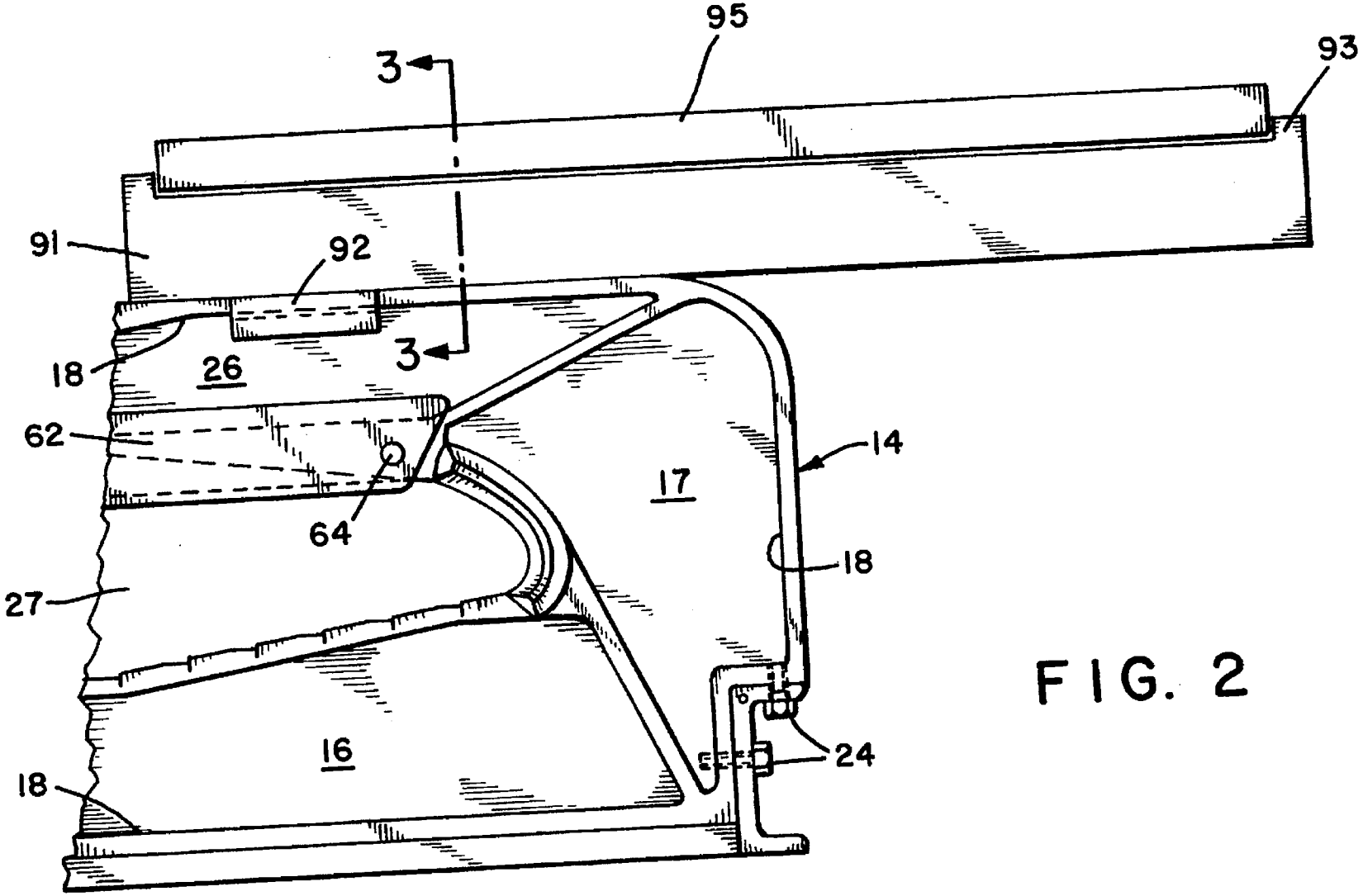
FIG. 2 is an end elevational view of FIG. 1 showing platform brackets attached to the brake with a platform positioned thereon with portions of the brake broken away for clarity.
Figure 4:
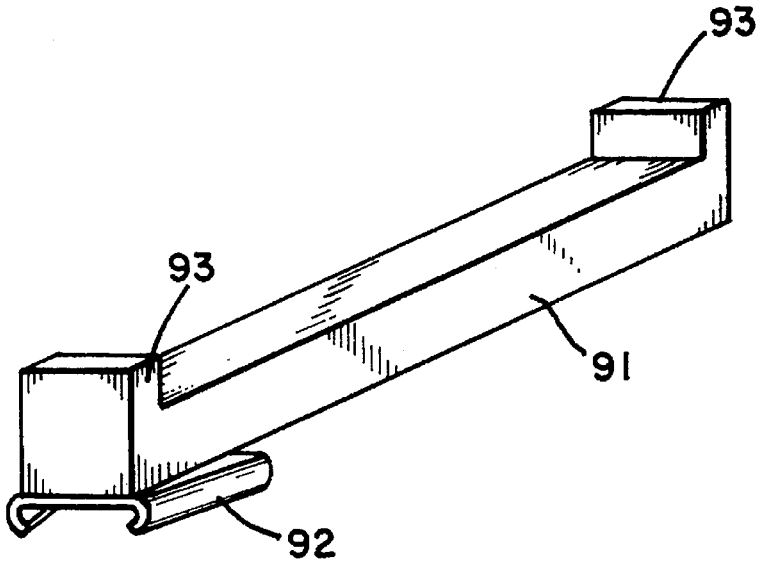
FIG. 4 is a perspective view of a platform bracket of the invention.

Longitudinally spaced C-shaped frames 14 secured to rails 11 and 12 are provided. Each frame comprises a lower arm 16, an upper arm 26 and a connecting intermediate section 17. The C-shaped members 14 are shown in FIG. 2 secured to rail 12 by bolts 24. The C-shaped frames 14 are generally formed having a lip or flange 18 around the periphery of each edge of the C-shaped frame as shown in the figure forming a I-shaped cross-section. The upper arm 26 overlies the lower arm 16 and forms an open jaw 27 therebetween. In the brake shown in FIG. 1, two C-shaped members are shown. However, it will be understood to those skilled in the art that brakes may contain a number of such C-shaped members up to 5, 7 or more depending on the length of the brake. The upper surface of upper arm 26 of the C-shaped member 14 is generally tapered outwardly from the open end of the C-shaped member for a portion of its length. The arm 26 shown in the figure however has generally parallel edges 19. The platform bracket of FIG. 4 is designed for use with an outwardly tapered upper arm and is secured thereto by placing the bracket on the upper surface of the upper arm and pushing the bracket toward the rear of the frame 14 to secure it.

While any construction could be used to form the bending brake, with reference to FIG. 1, a lower jaw 28 in a form of a T-shaped aluminum extrusion is fixed to the upper planer surface of lower arm 16 adjacent the forward edge thereof and a bending bar 32 in a form of an aluminum extrusion having generally the shape of the numeral 6 is hinged thereto. One or more bending bar handle members 34 are fixed to the bending bar for facilitating movement thereof. Lower jaw 28 and bending bar 32 are formed with mating integral projections along their longitudinal edges, which projections are provided with openings coaxially aligned so that when the projections are intermeshed a pin 36 may be extended through the openings to complete the hinge. In this manner, bending bar 32 is hinged to lower jaw 28 along an axis.

A shiftable anvil plate 38 is provided in overlying relation to the upper planar surface of lower jaw 28. A generally L-shaped floating hinge compensator 44 is provided in an overlying relation to the upper planar surface of bending bar 32 and is pivotally secured thereto by spring-loaded screws 46 which extend loosely through openings adjacent the lower edge of the compensator and through appropriately aligned openings in the bending bar. As the bending bar is swung upwardly, the compensator pivots relative to the screws 46 with foot portion 50 of the compensator thereof riding upwardly relative to the lower planar surface of the work piece, which is clamped relative to the anvil plate by a clamping subassembly to be described. When the work piece has been bent to the desired angular shape, the bending bar handle 34 is swung downwardly whereupon the foot portion 50 of the compensator 44 rides downwardly to return to its normal position wherein it overlies the hinge connection.

The clamping subassembly, generally indicated by 52, includes a clamping member 54 provided with sharp tapered lower most front and rear edges defining a flat clamping surface. The clamping surface is coextensive in length with anvil plate 38 and the clamping surface preferably has a hard wear resistant material sleeve such as stainless steel or the like for wearability.

Clamping member 54 is fixed at its opposite upper end by bolts (not shown) to the lower surface of the outer most end of a channel-shaped pivot bar 62 which bar 62 is pivoted at its opposite innermost end to upper arm 26 of each C-frame 14 as by a pivot pin 64.

A handle member 66 is linked to the pivot bar 62, whereby the clamping member may be moved into overlying relation to the shiftable anvil plate to clamp the workpiece of sheet material against the flat surface of the anvil plate. Handle member 66 is pivoted along one of its edges as by a pivot pin 68 to the forward end of upper arm 26 of each C-frame 14 and is pivotly connected to pivot bar 62 by a spring member 70. A tension spring 76 fixed at one end to upper arm 26 and at its opposite end to pivot bar 62 spring-loads clamping assembly 52.

Platform brackets 91 are shown secured only to upper arm 26 of C-shaped member 14 by a friction fit between lips 18 of upper arm 26 and platform bracket flange 92. The upper arm 26 is the only point the bracket 91 has to be secured to provide a support surface. The brackets are easily secured to, or removed from, the C-shaped members and when the platform brackets are secured, a substantially horizontal support surface is provided so that a platform such as 95 may be positioned thereon for use as a working surface. The platform bracket 91 is easily secured to the upper arm 26 or removed therefrom by sliding the bracket flange over the top surface of the upper arm 26 to fixedly engage the lips 18 of the upper arm. The platform brackets can be easily stored for reuse. Likewise, the platform 95 may be easily removed from the support surface and the bending brake and may be made in hinged sections so that it can be folded and easily stored. The platform may contain brackets in which a coiler can be positioned and secured to the surface of the platform.

Figure 3:
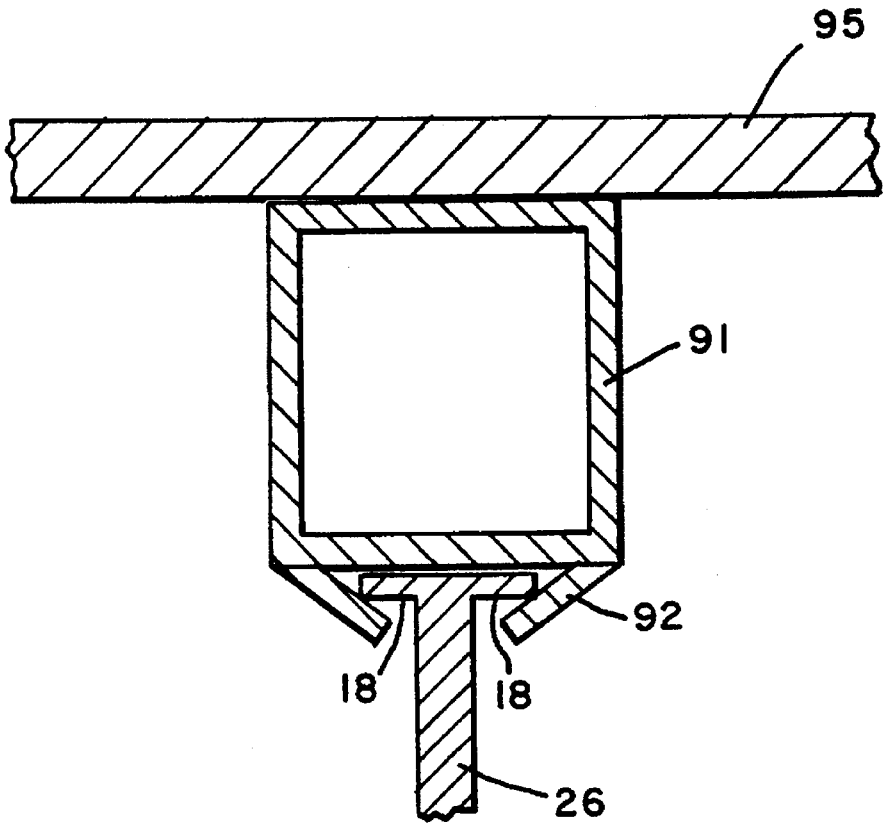
FIG. 3 is a cross-sectional view of FIG. 2 taken along lines 3—3.

FIG. 3 is a cross-sectional view of the upper arm 26 and flange 18 having attached thereto by force-fit a platform bracket 91 of the invention. Thus, platform 95 is positioned on the support surface provided by the upper surface of platform bracket 91 and flange 92 of the bracket is force fit over lips 18 of upper arm 26. Platform bracket 91 is shown in FIG. 1 as having projections 93 within which the platform 95 may be positioned and secured from movement along the longitudinal bracket axis. As discussed above, FIG. 4 shows a platform bracket 91 for use when the upper arm 26 of the C-shaped member tapers outwardly from the open end of arm 26.

In use, a workpiece (not shown) is positioned relative to lower arm 16 so that it rests upon anvil member 38 and the boot 50 of hinge compensator of 44. Handle member 66 is now swung downwardly to bring clamping member 54 into contact with the upper planar surface of the workpiece and the handle member is rotated counter clock wise to lock the clamping subassembly relative to the workpiece and anvil member. Bending bar handle member 34 is now swung upwardly to cause the compensator 44 to pivot upwardly relative to bending bar 32 thereby causing the workpiece to bend along the forward edges of the anvil plate and clamping member. When the workpiece has been bent to the desired angle, the handle member is swung downwardly and compensator 44 returns to its rest position. After use of the brake, the platform 95 and platform brackets may be easily removed and stored.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A combined sheet bending brake and platform comprising: a base;

a plurality of flanged C-shaped members secured on the base at longitudinally spaced points substantially transverse to the longitudinal axis of the brake;

each C-shaped member comprising a lower arm fixed to the base and an upper arm spaced from and overlying said lower arm and a connecting portion connecting the lower arm and upper arm the C-shaped member forming a jaw opening therebetween the upper arm and lower arm;

an anvil member secured to the upper planar surface of the lower arm of the C-shaped member;

a clamping surface for holding a sheet;

a bending member hinged for bending the sheet material about the anvil member; and a plurality of platform brackets each bracket being secured only to the upper arm of a C-shaped member forming a support surface substantially transverse to the longitudinal axis of the brake on which a platform extending longitudinally for at least a portion of the length of the brake can be positioned on; and wherein the brackets are secured to the upper arm of the C-shaped member by slideably engaging the bracket with the flange of the C-shaped member providing a friction fit between the bracket and the upper arm of the C-shaped member.

2. The combined sheet and bending brake of claim 1 wherein the platform brackets have upward projections at each end thereof between which the platform is positioned.

3. A combined sheet bending brake, platform and coiler for dispensing coiled sheet material to the platform for measuring, cutting and bending of uncoiled sheet material comprising:

a base;

a plurality of flanged C-shaped members secured on the base at longitudinally spaced points substantially transverse to the longitudinal axis of the brake;

each C-shaped member comprising a lower arm fixed to the base and an upper arm spaced from and overlying said lower arm and a connecting portion connecting the lower arm and upper arm the C-shaped member forming a jaw opening therebetween the upper arm and lower arm;

an anvil member secured to the upper planar surface of the lower arm of the C-shaped member;

a clamping surface for holding a sheet;

a bending member hinged for bending the sheet material about the anvil member; and a plurality of platform brackets each bracket being secured only to the upper arm of a C-shaped member forming a support surface substantially transverse to the longitudinal axis of the brake on which a platform extending longitudinally for at least a portion of the length of the brake can be positioned on; and wherein the brackets are secured to the upper arm of the C-shaped member by slideably engaging the bracket with the flange of the C-shaped member providing a friction fit between the bracket and the upper arm of the C-shaped member and the platform has brackets thereon in which the coiler can be positioned and secured to the surface of the platform and the coiled material uncoiled onto the platform, measured, cut and bent to the desired shape.

4. The combined sheet bending brake, platform and coiler of claim 3 wherein the platform is made in hinged sections so that the platform can be folded and easily stored.

* * * * *